United States Patent [19]

Miyagawa et al.

[11] 4,314,147

[45] Feb. 2, 1982

[54] MULTI-FUNCTION TYPE SHEET COUNTING MACHINE

[75] Inventors: Tuyoshi Miyagawa; Eiko Hibari, both of Tokyo, Japan

[73] Assignee: Laurel Bank Machine Co., Ltd., Tokyo, Japan

[21] Appl. No.: 105,071

[22] Filed: Dec. 19, 1979

[30] Foreign Application Priority Data

Dec. 22, 1978 [JP] Japan ..... 53-177217[U]

[51] Int. Cl.[3] ..... G06M 9/02

[52] U.S. Cl. ..... 235/92 SB; 235/92 MS

[58] Field of Search ..... 235/92 SB, 92 MS, 92 FP, 235/92 EC, 92 DE, 144 E; 271/103, 112

[56] References Cited

U.S. PATENT DOCUMENTS 3,846,624 11/1974 Kawanake ..... 235/92 MS
4,044,232 8/1977 Hubbard ..... 235/92 SB
4,105,914 8/1978 Murata et al. ..... 235/92 SB
4,227,074 10/1980 Miyagawa ..... 235/92 SB
4,227,686 10/1980 Uchida et al. ..... 235/92 SB

*Primary Examiner*—Joseph M. Thesz
*Attorney, Agent, or Firm*—Fleit & Jacobson

[57] ABSTRACT

A multi-function type sheet counting machine capable of counting sheets under a desired operational mode selected from a plurality of operational modes. As the sheets to be counted are deflected one after another away from a stack of sheets, electrical count pulses corresponding to the number of deflected sheets are generated, and a count corresponding to the number of generated pulses is stored in a counter. A reset circuit is provided so that, at the time of changing over to the add mode from any other operational mode, the counter is automatically reset to clear the count previously stored in the counter.

3 Claims, 3 Drawing Figures

MULTI-FUNCTION TYPE SHEET COUNTING MACHINE

BACKGROUND OF THE INVENTION

This invention relates to a sheet counting machine of multi-function type.

Multi-function type sheet counting machines are generally designed to carry out counting operation in any of a plurality of operational modes such as add mode, check mode, batch mode and print mode. The machine has mode selection switches for selecting one of the operational modes. When a stack of sheets, such as paper sheets, is loaded into a counting portion of the machine, counting of the number of the sheets of the stack is carried out under the selected operational mode. In the add mode, the sheets of a stack or stacks are counted to obtain the total sum of the sheets of the stack or stacks. In the check mode, a preset reference value and an actually counted value of sheets are compared with each other thereby to check whether these two values are the same. In the batch mode, the desired number is preset in the machine and the preset number of sheets are counted, separated from and removed from the stack of sheets. In the print mode, a similar counting operation as that in the check mode is carried out, and, when the actually counted value is the same as the preset reference value, a stamp is printed on the wrapper of the stack of sheets.

In carrying out operation in any of the check mode, the batch mode and the print mode, it is undesirable for the count of the previously carried out operation to remain in the counter. Accordingly, when the next stack of sheets is moved by the holder in the counting portion of the machine to the counting position, a detection signal is generated thereby to automatically reset the counter to clear the count stored therein with respect to the previously operation.

In the add mode, however, when the total number of sheets of a plurality of stacks is counted, the count for the previously counted stack of sheets is required to be retained in the counter. Accordingly, convetional sheet counting machines are so designed that, in the add mode, the counter is not automatically reset when the next stack of sheets is loaded into the holder. Consequently, with such a conventional machine, when, for example, check mode operation is first carried out and then the mode selection switch is operated to change over the operational mode from check mode to add mode and the counting operation with respect to a new stack of sheets is started, the count for the previous check mode is not cleared and remains in the counter. As a result, the count of the previous check mode is undesirably added to the count of the new stack of sheets.

More particularly, in the prior art machine, in a case where the operational mode is first set to check mode and a reference number "a" is set, the holder is disengaged from the counting position and the count contents representing "a" are stored in the counter when the counted number of sheets, in the stack of sheets loaded in the holder reaches "a". In this condition, if the operational mode is changed over from the check mode to add mode and the counting operation is inadvertently started, without depressing the clear button for clearing the count "a" stored in the counter, to count new stacks consisting respectively of "b" number of sheets and "c" number of sheets, for example, for storing the sum "b+c" in the counter, the count stored in the counter then becomes "a+b+c", because "a" has already been stored in the counter. The desired sum "b+c" is therefore not displayed by the display unit. Accordingly, with the conventional machine, there has been the inconvenience that manual operation has been required to reset the counter to clear the previously stored count, i.e. "a".

SUMMARY OF THE INVENTION

It is therefore a general object of the invention to provide an improved multi-function type sheet counting machine which eliminates the abovedescribed inconvenience in the conventional machine.

Another object of the invention is to provide a multi-function type sheet counting machine which is provided with a reset circuit for automatically resetting the counter at the time the operational mode is changed over to add mode from any other mode.

In a multi-function type sheet counting machine for conducting counting operation under a desired operational mode selected from a plurality of operational modes which includes a counting mechanism for holding a stack of sheets to be counted and deflecting the sheets one after another away from the stack, means for selecting an operational mode from a plurality of operational modes, a pulse generator for generating electrical count pulses corresponding to the number of the deflected sheets, and a counter for counting the generated pulses and storing the count corresponding to the number of generated pulses, according to the invention, there is provided a reset circuit for automatically resetting the counter at the time of changing over the operational mode to add mode from other operational mode thereby to clear the count which has been stored in the counter. Thus, according to the invention, inadvertent failure to reset the counter at the time of changing over the operational mode to add mode from other operational mode can be avoided and the desired count can be stored in the counter without fail.

DESCRIPTION OF THE DRAWINGS

Other objects and advantages of the present invention will become apparent from the following description made with reference to the accompanying drawings, in which.

DESCRIPTION OF THE PREFERRED EMBODIMENT

One embodiment of the present invention will now be described in detail with the reference to the accompanying drawings.

Figure 1:
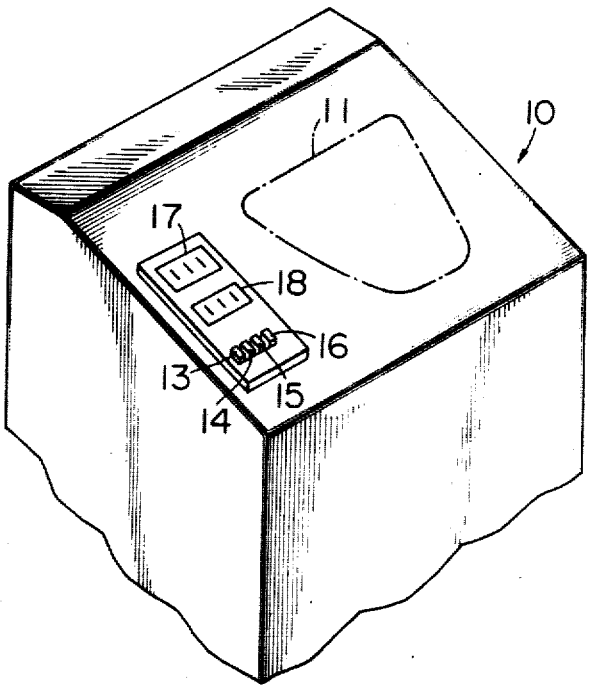
FIG. 1 is a perspective view schematically illustrating an embodiment of the sheet counting machine according to the invention.

Referring to FIG. 1, the front panel in the body 10 of a sheet counting machine is provided with a counting mechanism 11, which will be described hereinbelow in connection with FIG. 2, mode selection switches 13 to 16, a display unit 17, and a preset unit (setting unit) 18. The mode selection switches 13, 14, 15 and 16 are so designed to permit alternative selection of the check, batch, add and print modes.

Figure 2:
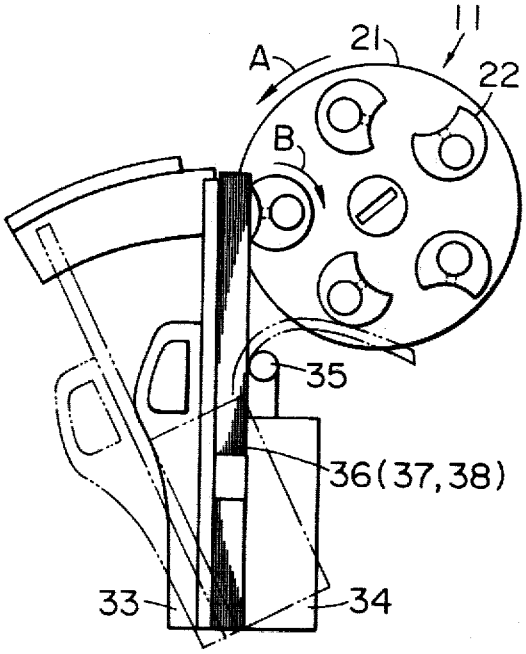
FIG. 2 is a plan view illustrating the counting mechanism incorporated in the embodiment of FIG. 1.

Referring to FIG. 2, the counting mechanism 11 comprises a rotary cylinder 21, a plurality (five in this embodiment) of suction heads 22 which are carried on the cylinder 21, a holder 33 and a support rod 35. At the initial stage, the holder 33 is at the position shown by the two-dot chain lines. When a stack of sheets 36, paper sheets, for example, is placed on the support portion 34 of the holder 33, this stack of paper sheets 36 is detected by a photo-detector (not shown), and the holder 33 is automatically rotated clockwise to a position shown by the solid lines, where the stack of paper sheets 36 is held between the holder 33 and the support rod 35. The cylinder 21 and the suction heads 22 are so designed to be rotated respectively in the directions of arrows A and B when a vacuum switch 29 (FIG. 3) is turned on, as will be described in detail hereinbelow, thereby to deflect the paper sheets one after another away from the stack of paper sheets 36 held on the holder 33.

Figure 3:
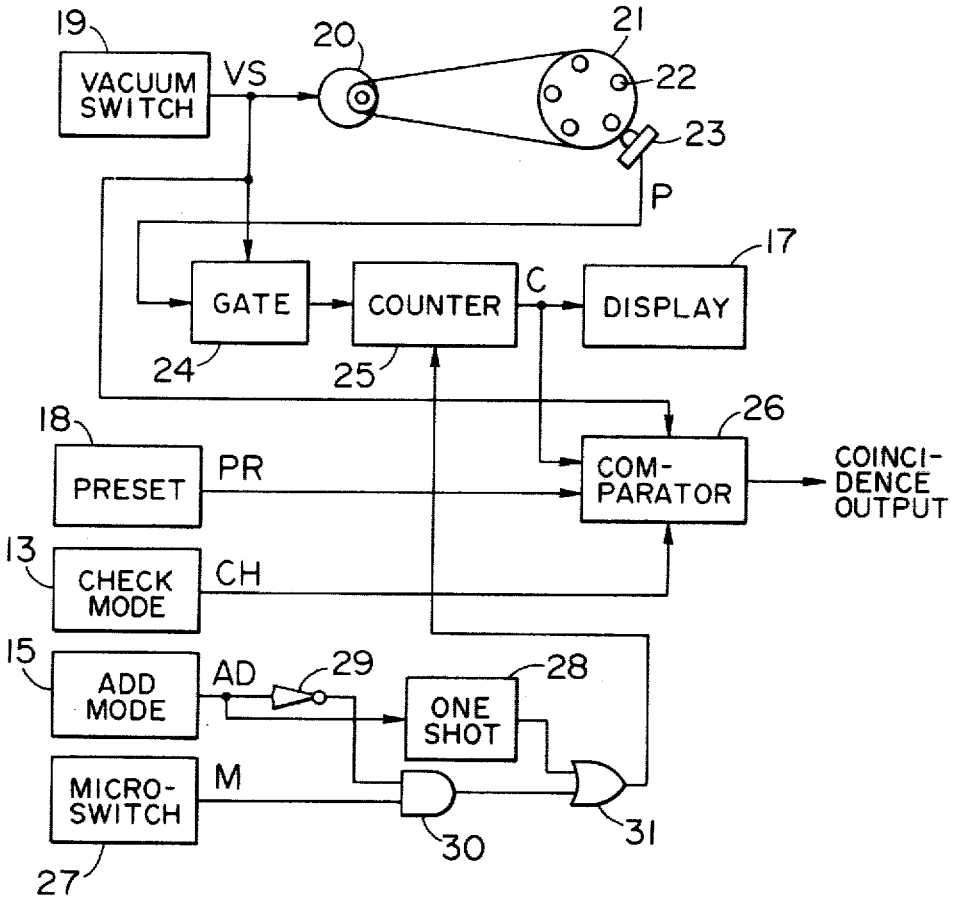
FIG. 3 shows a block diagram of the electric circuit employed in the embodiment of FIG. 1.

An electric circuit employed in this embodiment will now be described in connection with FIG. 3. Referring to FIG. 3, the vacuum switch 19 is so designed that it detects negative pressure in a vacuum pump (not shown) and, when the value of the detected negative pressure is larger than a reference negative pressure, then the switch 19 is turned on and, when the value of the detected negative pressure is smaller than the reference negative pressure, then the switch 19 is turned off. In accordance with such turning-on or turning-off of the vacuum switch 19, a signal VS corresponding to the "ON" or "OFF" state is output by the switch 19 and is sent to a counting motor 20, a gate circuit 24 and a comparator 26. Thus, the counting motor 20, the gate circuit 24 and the comparator 26 are controlled by such signal VS.

When the vacuum switch 19 changes over from OFF to ON, the counting motor 20 starts its rotation to cause the cylinder 21 and the suction heads 22 to rotate in the directions described above thereby to deflect the paper sheets one after another away from the stack of paper sheets 36 (FIG. 2). Every time one paper sheet is deflected, one counting pulse P is generated by a pulse generator 23. The pulses P are sent, at the time when the vacuum switch 19 is turned ON and the gate circuit 24 is opened, to a counter 25. The counter 25 counts the pulses P which are sent thereto, and sends count output C to the display unit 17 and the comparator 26. The display unit 17 displays the output C from the counter 25. As for the comparator 26, in addition to signal VS from the vacuum switch 19 and count output C from the counter 25, it receives check signal CH from the check-mode selection switch 13 and preset value PR from the preset unit 18. When the sheet counting machine is put in check mode by operation of the check-mode selection switch 13 and when the above-mentioned signal VS changes from "ON" to "OFF", count output C and preset value PR will be compared with each other. When the count output C and the preset value PR are identified to be the same, coincidence output will be generated.

The add mode selection switch 15 puts signal AD in a first input of an AND circuit 30 through an invertor 29 and also directly in a one shot multivibrator or circuit 28. This signal AD becomes binary logic signal "1" when the operational mode is changed to add mode by operation of the add mode selection switch 15, and becomes binary logic signal "0" when the operation mode is changed to other mode than the add mode. The one shot circuit 28 generates a "1" pulse when signal AD has changed from "0" to "1", i.e., when the operational mode has been changed over to the add mode from any of the other operational modes.

A microswitch 27 is provided in the counting mechanism 11. When the holder 33 has moved from the position shown by the two-dot chain lines in FIG. 2 to the position shown by the solid lines, i.e., at the time just before starting of the counting operation, the actuator of the microswitch 27 is depressed by a cam (not shown) or the like, and output M from the microswitch becomes "1". This output M is put in a second input of the AND circuit 30. The output from the one shot circuit 28 and the output from the AND circuit 28 are put in first and second inputs of an OR circuit 31, respectively. Output from the OR circuit 31 is put in the counter 25 as a reset signal, and the counter 25 is reset when the output from the OR circuit 31 is "1".

Operation of the sheet counting machine having the above-described construction will now be described. Description will be made first with respect to the operation in check mode, and then with respect to the operation of changing over the operational mode to add mode.

Referring to FIGS. 1 to 3, for conducting check mode operation, the check-mode selection switch 13 is first operated to set the operational mode to check. A reference count number, i.e., the desired number of paper sheets to be counted, 100 (one hundred) for example, is set by operating the preset unit 18. Thereafter, a stack of paper sheets 36 is placed on the support portion 34 of the holder 33. At this time, this stack of paper sheets 36 is detected by the photo-detector, and the holder 33, which is in the position of the two-dot chain lines in FIG. 2 at the initial stage, moves to the position of the solid lines thereby to hold the stack of paper sheets 36 between the holder 33 and the support rod 35. With the holder 33 in this position, the outer surface of the stack of paper sheets 36 comes into close contact with the suction face of one of the suction heads 22, the degree of internal negative pressure of the above-mentioned vacuum pump becomes larger and exceeds the reference negative pressure, and the motor 20 is started to rotate the cylinder 21 and the suction heads 22 in the directions of arrows A and B, respectively. Thus, the paper sheets of the stack 36 are deflected one after another away from the stack 36 held on the holder 33.

When the holder 33 moves from the position of the two-dot chain lines in FIG. 2 to the position of the solid lines, the cam (not shown) depresses the actuator of the microswitch 27 thereby to make its output M become "1" temporarily. At this time, since the operation is in the check mode, output AD from the add mode selection switch 15 is "0", and input at the first input of the AND circuit 30 is "1". Accordingly, in response to the output M from the microswitch 27 which has just become "1", output from the AND circuit 30 becomes "1", and this "1" output from the AND circuit 30 is put in the counter 25 as a reset signal. Thus, by the movement of the holder 33 to the position of the solid line in FIG. 2, the count of the previous counting operation stored in the counter 25 is cleared, erroneous counting thus being avoided.

As the paper sheets are deflected one after another away from the stack 36, the count pulse generator 23 accordingly generates count pulses P one after another. At this time, since the vacuum switch 19 is ON, the gate circuit 24 is open, the above-mentioned count pulses P are counted by the counter 25, and the corresponding count output C from the counter 25 is sent to the display unit 17 for displaying. This count output C is also sent to the comparator 26, and is compared with the preset value PR after the counting has been finished. More particularly, when all the paper sheets of the stack 36 have been deflected and the internal negative pressure of the vacuum pump has become smaller than the reference negative pressure, the vacuum switch 19 is turned off. Consequently, the gate circuit 24 is closed, and the counter 25 stops counting the count pulses P, the count output C from the counter 25 at this point of time representing the actually counted number, "100", for example, of the paper sheets of the stack 36. With the vacuum switch 19 being turned off, the comparator 26 compares the above-mentioned preset value PR, "100", for example, with the count output C, "100", for example, from the counter 25, and, when these PR and C coincide with each other, the comparator 26 generates coincidence output. This coincidence output is adopted as the driving output for moving the holder 33 from the position of the solid lines in FIG. 2 to the position of the two-dot chain lines. As a result, the stack of paper sheets 36 is disengaged from the support rod 35 and can be taken out from the holder 33 by the operator.

On the contrary, when output C from the counter 25 is not coincident with the preset value PR, then the comparator 26 generates no coincidence output, the holder 33 remains at the position of the solid line in FIG. 2, and the operator cannot take out the stack of paper sheets 36 from the holder 33. The operator will then become aware of the lack of coincidence, and manually operate a reset button (not shown) to move the holder 33 to the position of the two-dot chain lines in FIG. 2. He will the remove the faulty stack of paper sheets 36 from the holder 33.

Description will now be made about a case where, after a stack of paper sheets 36 has been subjected to check mode processing and it has ascertained that the stack of paper sheets 36 has the predetermined number of sheets, 100 sheets, for example, the operational mode is changed over to add mode for obtaining the sum of sheets in other stacks 37 and 38 (FIG. 2).

For conducting such add mode operation, the add mode selection switch 15 is operated to change over the operation to add mode. With this, output signal AD from the add mode selection switch 15 becomes "1", and accordingly input to the first input of the AND circuit 30 becomes and is maintained at "0". Accordingly, if an output of "1" is supplied from the microswitch 27 before start of counting and be put in the second input of the AND circuit 30, output from the AND circuit 30 will not become "1" and the counter 25 will not be reset before the start of the counting of each the stacks of paper sheets 37 and 38, and accordingly the counter 25 will give a sum of sheets of the stacks 37 and 38, as will be described hereinbelow.

Further, when the operation is changed over to the add mode and output signal AD from the add mode selection switch 15 changes from 0" to "1", a pulse is generated from the one shot circuit 28 and is put in the counter 25 as a reset signal thereby to reset the counter 25. Thus, count C, "100" for example, for the previous check mode operation stored in the counter 25 is cleared before counting is started with respect to the stack of paper sheets 37. Accordingly, the inconvenience experienced in the prior art, i.e., the inconvenience of count obtained before changeover of the operation to add mode possibly being undesirably added to the count in the next operational mode, is eliminated.

The paper sheets of the stack of paper sheets 37 on the holder 33 are deflected one after another by the counting mechanism 11 in a similar manner as in the check mode, and the count pulse generator 23 generates pulses P in a number corresponding to the number of sheets which are deflected. Since the counter 25 has been reset at the time of changing the operation over to add mode as described above, the counter 25 counts these pulses P beginning from "0". Accordingly, supposing that the stack of paper sheets 37 consists of 80 sheets, for example, when counting of this stack of paper sheets 37 has been finished, count output C from the counter 25 is "80", and the display unit 17 accordingly displays "80". When all the paper sheets of the stack 37 have been deflected, the vacuum switch 19 is turned off. With the vacuum switch 19 turned off, the holder 33 moves from the position of the solid lines in FIG. 2 to the position of the two-dot chain lines. Accordingly, the operator can perceive that the counting of the stack of sheets 37 has been finished, and take out this stack of paper sheets 37 from the holder 33.

Thereafter, in counting with respect to the stack of paper sheets 38, the counter 25 begins counting from "80", i.e., from the number of sheets of the previously counted stack 37. Supposing that the stack of paper sheets 38 consists of 120 sheets, then, when all the paper sheets of the stack 38 have been deflected the count output C from the counter 25 becomes "200" (=80+120), and "200" is displayed by the display unit 17. At the same time, the holder 25 moves from the position of the solid lines in FIG. 2 to the position of the two-dot chain lines. The operator can then perceive the completion of the counting of the stack of paper sheets 38 and take out this stack 38 from the holder 33. Thus, the paper sheets of the stacks 37 and 38 can be summed up independently of the count obtained in the previous check mode operation, that is, the count in the previous check is not added to the count in the following add mode operation.

While, in the above, description has been made about the case where check mode has been first conducted and then add mode has been carried out, in another case where another operational mode such as batch mode or print mode is first conducted and then add mode is carried out, this add mode operation can proceed independently of the previous batch mode or print mode operation. That is, the count of the previous batch mode or print mode operation is not added to the count in the following add mode operation.

As will be understood from the above, according to the invention, every time the operational mode is changed over to add mode, the counter is reset, and accordingly the count stored in the counter before such changeover of operational mode is automatically cleared at the time of such changeover. Accordingly, only the sum of counts in the add mode operation, exclusive of the count in other previously conducted mode of operation, can be obtained without manual operation of the reset button.

While the above description uses paper sheets, as an example, it should be apparent that the invention can be applied to various sorts of bendable sheets.

It should be understood that various changes and modifications can be made without departing from the spirit and the scope of the invention.

What is claimed is:

1. A multi-function type sheet counting machine comprising:

a sheet holder;

a counter for counting sheets disposed on the holder, wherein a stack of sheets disposed on the sheet holder is brought to a counting position and then counted by the counter during a counting operational mode selected from a plurality of counting operational modes, with one of the counting operational modes being an add mode; and control means for controlling said counter such that, when one counting operation of said add mode is completed, the counter maintains the content of the counter, and such that, when one counting operation of one of said other counting operational modes is completed, the counter is caused to be reset to clear the content of the counter prior to the next counting operation, said control means comprising:

a microswitch associated with the holder for generating a first signal to reset the counter when the holder is brought to the counting position, first means for blocking the generated first signal from being transmitted to the counter when the sheet counting machine is in said add mode, and second means for generating a second signal tc reset the counter when the sheet counting machine is changed to said add mode from one of said other counting operational modes.

2. A multi-function type sheet counting machine according to calim 1, wherein said first means comprises an AND gate having a first input connected to said microswitch and a second input, said control means having an inverter, an add operational mode selection switch, and means for generating a condition signal representative of the condition of the add operational mode selection switch, said condition signal being fed through said inverter to said second input of said AND gate so that said AND gate blocks transmission of said first signal when said add operational mode selection switch is positioned to set said sheet counting machine in said add mode, said AND gate passing said first signal when said machine is in one of said other counting operational modes.

3. A multi-function type sheet counting machine according to claim 1, wherein said second means comprises a one shot multivibrator, responsive to a change in said condition signal upon initial setting of said machine in said add mode, for generating said second signal.

* * * * *